United States Patent [19]

Menz

[11] Patent Number: 4,720,888

[45] Date of Patent: Jan. 26, 1988

[54] WIPING AND CLEANING PAD GRIPPER

[76] Inventor: John A. Menz, 7010 Heege Ave., Apt. 206, St. Louis, Mo. 63123

[21] Appl. No.: 861,581

[22] Filed: May 9, 1986

[51] Int. Cl.[4] ..... B41F 35/00

[52] U.S. Cl. ..... 15/257 R; 15/104 R; 15/209 R; 15/222

[58] Field of Search ..... 15/104 A, 118, 147 R, 15/147 A, 208, 209 R, 209 D, 210 R, 220 R, 222, 228, 230.17, 244 R, 244 A, 104 R; 428/100; 24/306, 442; 248/205.2; 52/DIG. 13

[56] References Cited

U.S. PATENT DOCUMENTS

| | | | |
|---|---|---|---|
| 3,590,414 | 7/1971 | Gores | 15/244 R |
| 3,854,239 | 12/1974 | Williams | 24/442 |
| 3,943,592 | 3/1976 | Bhaskar et al. | 15/167 |

FOREIGN PATENT DOCUMENTS

| | | | |
|---|---|---|---|
| 6708504 | 12/1968 | Netherlands | 15/228 |

*Primary Examiner*—Edward L. Roberts
*Attorney, Agent, or Firm*—Paul M. Denk

[57] ABSTRACT

A wiping and cleaning pad gripping apparatus for use for wiping proofs, developed films, or related materials in the printing and graphics industry, including a length of polygonal bar, having hand gripping elements, preferably coated, provided laterally and to either side, the bar incorporating adhering material, in the form of either hook or pile connector means, to the various exposed surfaces of the bar, and to which the wiping pad, fabricated of either a cloth or foam texture may be wound about the apparatus in preparation for its usage for cleaning these identified materials. The hook or pile connector means may be adhesively applied to the bar surfaces, for permanent retention thereagainst, and to prevent any removal or loosening even after repeat wiping cloths are applied thereto, and cleaning solutions saturated thereupon for prudent and reasonable lengths of time.

10 Claims, 12 Drawing Figures

WIPING AND CLEANING PAD GRIPPER

BACKGROUND OF THE INVENTION

In the printing arts, and particularly in various phases of film processing, proof processing, printing plate preparation, and press roller cleaning, etc., it is necessary to provide a means for effectively handling the wiping or cleaning of these types of processing means as applied in the graphic arts. Generally, during proof or plate processing, various image processing chemicals are employed in the assembly of, as for example, a pre-press proof during its preparation, and through exposure to the various light means that are employed during proof exposure, such as the use of ultra-violet light, and further upon application of various coloring toners, it then becomes necessary to wipe clear and clean those segments of the chemicals which do not adhere to the exposed hardened areas, to complete the proof preparation, which may even include repeat applications as in the preparation of multi-color type proofs. Generally, this wiping procedure for removal of the unadhered toner and other chemicals is through the application of some form of a wiping cloth, or foam sheet cleansing means, which may include its being treated with a dry or solvent soaked ingredient, applied to the surface of the proof, film, or the like, in order to wipe clean those portions of the prepared surface which are required for removal. It is this latter procedure which has been rather difficult of performance, not so much from the standpoint that means are unavailable for accomplishing the procedure, but normally, unless the proper instrument is available for effecting this particular process, the operator must simply apply a wiping cloth by hand, which not only may achieve the cleaning process rather ununiformly, but in addition, frequently causes the printer to soil both his/her hands and clothing in performing this rather dirty task.

There are mechanisms that have been available in the art for accomplishing the wiping of proofs and plates. For example, the industry has frequently used a structure and has employed a device that appears in the nature of a longitudinal hinge, incorporating a pair of hinged plates, with the wiping cloth being applied between the hinges as they are pivoted into closure, and then wrapping the cloth about the closed hinge a sufficient number of turns to provide a wiping pad. While this particular procedure is reasonably effective for accomplishing its intended purpose, it is necessary for the operator to initially open the hinged plates, in order to first insert the edge of the wiping cloth or foam material therein, and then close the same, for gripping of the pad, in preparation for its wrapping about the holder of this style. In addition, other means have been employed for accomplishing this particular function in the treatment of film or plates, such as through the use of a pair of clamping members, that are gripped about the pad initially, having the pad then wrapped about their pair of grippers, in order to obtain a wiping pad of the required design. As previously stated, while these type of pad grippers have been available in the art, and have long been employed in the printing industry, for attaining their intended results, even somewhat effectively, the one draw back is that it does require a bit of manipulation in the first instance, in the movement of the hinge plates, or the pair of gripping members, into a position initially for grasping of the wiping cloth, and then to be further processed before the cloth can be wound about its gripper into its usable form. This particular function has been totally obviated through the style of pad gripper as fabricated and comprising the subject matter of this invention, wherein the gripper bar itself incorporates inherently its own adhering means that need only be pressed into contact with the cloth or foam pad material, being instantly adhered thereto, in preparation for a further rolling of the bar until such time as a pad of sufficient thickness has been built up in preparation for usage in the graphics arts, for the purposes as previously explained.

SUMMARY OF THE INVENTION

This invention relates generally to a novel style of gripping means for use for application in the printing and graphic arts, and for furnishing a wiping pad of material incorporating with its gripper and which can be readily applied for cleaning of film, proofs, or printing plates during processing.

The cleaning and wiping pad gripper of this invention has been designed for use, as previously explained, in both the graphics and printing industries, as an efficient apparatus, readily available and easily prepared for the printer or film processor to facilitate the task of completing the preparation of a proof, or the like. The apparatus is designed for providing a hand held wiping/-cleaning pad gripping device and to which pad the various dry or solvent soaking solutions can be readily applied, and which are used in the various phases of film processing, proof production, printing plate processing, press roller cleaning, and related type of operations. The gripping bar of this invention is designed as a length of bar means, generally having a length dimension which is greater than the proof or film being processed, and which can readily accept and have adhered to it the various foam or cotton pads, which immediately grip or cling to it in a functionally secure manner in preparation for performance of this cleaning processing step. More specifically, the bar means of this invention is contemplated to incorporate a layer of adhering means, such as one of the hook and pile connecting means, normally identified in the trade as Velcro, which may be applied to at least one of the bar means surfaces, although preferably, the upper and lower surfaces of the bar means are intended for application of the "hooked" fabric of this hook and pile type of fastener means for use for ready adherence of the wiping cloth.

In addition, the bar means is intended to have, preferably, a somewhat greater length than that width customarily given to the wiping cloth as used in this industry. Hence, by extending the bar means a sufficient distance to either side, in order to facilitate their grip by the operator, this presents an apparatus which also can be easily grasped by the operator during the performance of a cleaning function, having an overall length, also incorporating the two lateral hand gripping areas, that overlap the proof film, or plate upon which exposure has been made, so as to add to the convenience of the user while undertaking the cleaning of the proof during its preparation. The bar means of this invention is designed for hand usage, but it is just as likely that its subject matter could be adapted for application to a mechanical type of operation for cleaning of various exposed plates, or the like. With the wrapping of the wiping cloth a number of times around the bar means, with its initial wraps being held in place by means of the hooked connecting means, this invention fills the need for a wiping/cleaning pad holder, or gripper, which secures the pad readily enough so that it will not flop or stub off while in application, but yet which can be quickly and easily removed for replacement or disposal, after the wiping cloth has become excessively soiled during usage. This invention is specifically designed to replace other types of devices currently in use, which require the application of a plurality of separable or hinged metal or other parts, and which necessitate about twice the amount of pad material per usage, in addition to consuming a significantly greater amount of time for the user to assemble and disassemble the apparatus in preparation for and after usage.

Obviously, the usage of this particular invention in the graphics industry in not intended to preclude its possible use in other fields, where its functionality can be determined, as enhancing the art of wiping particular components during their processing. But, obviously, the subject matter of this invention has found immediate usage and efficient application in the printing and graphics industry.

The size and configuration of the pad gripper of this invention is a function of and is determined by the specific industrial, commercial, or domestic use to which it is put. The structural portion of the prototype of this invention is preferably metal, and more specifically aluminum, due to its enhanced rigidity and permanance, but it is just as conceivable that the subject matter of this invention, or more specifically its bar means, could be formed from other materials, such as plastic, wood, other metals, or the like. In addition, and while the prototype of this invention, as described in this application, may be two sided, it is just as likely that the bar means could be shaped triangularly, be square, rectangular, or be polygonal, or it may even be formed round in configuration. Actually, the more sides provided upon the bar means of this invention, the greater will be the number of wiping surfaces that are available for application as needed. The primary uniqueness of this invention is its ability to pick up, hold, with very light tack, the light-weight, porous, disposable wiping/cleaning materials, whether it be of cloth or layered foam, for the purpose of wiping and cleaning with a consistent, even-weighted pressure across a wiping surface, whether it be a pre-press proof, an exposed film, a plate being processed, or for roller cleaning applications, or the like.

But, in the preferred embodiment, the hooked nylon portion of the hook and pile style of connecter means, generally identified as Velcro, is preferably adhered, by way of an adhesive to the upper and lower surfaces of the bar means which is the supporting structure for this invention. In addition, the two ends of the bar means, as previously explained, extend sufficiently laterally of the hooked adhering means, in order to form gripping surfaces to which the hands of the operator may be applied, and these lateral extensions may likewise be dipped or otherwise coated with a polymer, rubber compound, or the like, to facilitate their hold by the user. In addition, the adhesive employed for securing the adhering means onto the surface of the bar will be one which is preferably of a rubberized composition, normally applied from the roll form, and marketed as No. 465 by 3M Company of Minneapolis, Minn. It is used in the attachment of the hooked connecting means onto the surface of the bar, and which adhesive will not be subject to dilution, dissolving or weakening, due to its repeated exposure through the soaking of the wiping cloth with any dry or liquid solvent, that is applied onto the wiping cloth, either in preparation for or during its application. Usually these solvents are an acetone-alcohol-water solution, and the applied adhesive will be resistive to these type solvents if they are used prudently with short drying periods.

BRIEF DESCRIPTION OF THE DRAWINGS

In referring to the drawings,

FIG. 10 is a plan view of the apparatus as shown in FIG. 8, but in this instance disclosing a wiping cloth having been wrapped about it in preparation for its application for cleaning of a plate, proof, or the like;

DESCRIPTION OF THE PREFERRED EMBODIMENT

Figure 1:
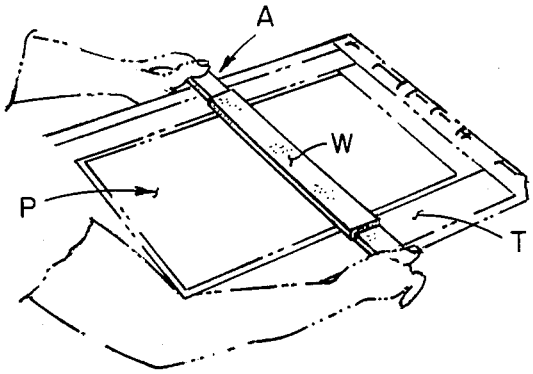
FIG. 1 provides an isometric view of a proof being prepared, showing the operator moving the wiping and cleaning pad gripper of this invention along the length of the coated surface during performance of a cleaning function.

In referring to the drawings, and in particular FIG. 1, therein is shown the wiping and cleaning pad gripping apparatus A of this invention, as being held by its lateral edges by the printer, in wiping the residue material from, as for example, a prepress proof P resting upon its table T, platen, or other supporting surface. More specifically, as previously explained, the gripping apparatus A of this invention has its wiping cloth or foam sheet W wrapped upon it, as can be seen, and which spans the width of the proof, film, or the like, to be cleansed.

Figure 2:
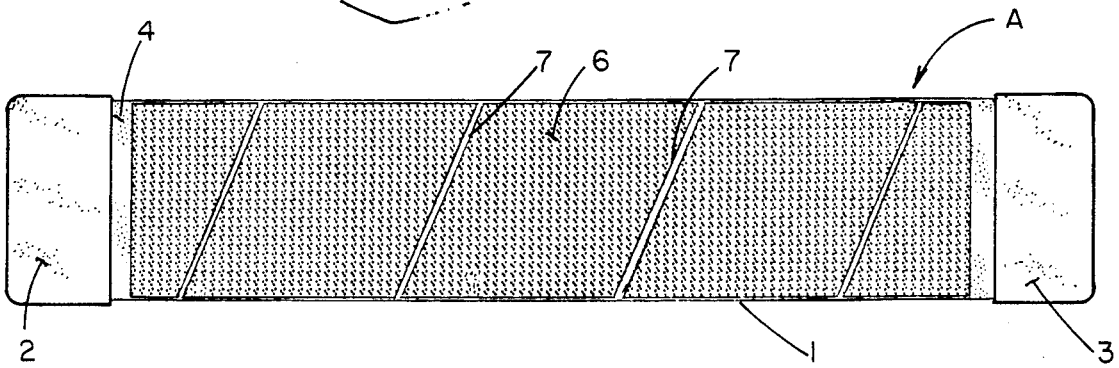
FIG. 2 is a plan view of the gripper bar means of this invention, with the wiping cloth shown as being removed.
Figure 3:
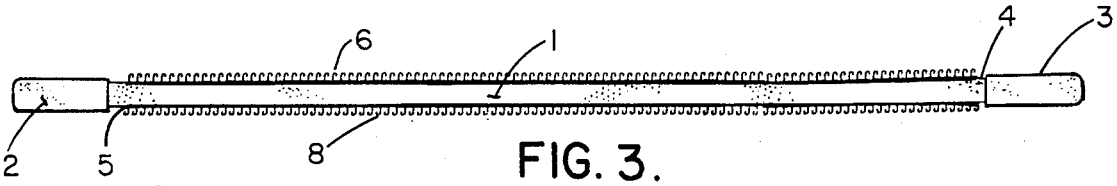
FIG. 3 is a front edge view of the bar means disclosed in FIG. 2.

In referring to FIGS. 2 and 3, in addition to 6, one example, or one embodiment of the gripper A of this invention is disclosed, and generally is fabricated of bar stock, as at 1, and which has sufficient length so as to provide for its expansive transversal arrangement across the surface being cleaned, and in addition, have yet even further lateral extension, as at 2 and 3, to provide areas for end gripping by the operator, for holding of the apparatus during its application. In addition, these lateral gripping segments may be coated, as with a form of rubber composition, any type of polymer, or the like, as can be clearly seen in FIG. 3, so as to facilitate the retention of this gripping apparatus by the user during its application.

As can also be clearly seen in FIG. 2, the upper and lower surfaces, or perhaps just the upper or the lower surface, as at 4 or 5 of the bar means 1 of this invention, has applied to it means for facilitating the folding of the wiping cloth by the apparatus during its preparation for usage. Such gripping means as one of the hook or pile form of connecting means, generally identified in the trade as Velcro, has been found useful for this purpose. In the particular embodiment, as shown in FIG. 2, the gripping means comprises the "hooked" form of adhering apparatus, and which as generally known, forms a series of miniscule upright polymer molded hook-like means, as so clearly shown in FIG. 3, and which have a tendency to firmly adhere onto any soft pile surface, such as that from which the cloth or cotton wiping pads or foam pads as used in the photographic arts are fabricated. This adhering means, comprising the hooked connecter means of this invention, as shown at 6, are generally formed segmented, since this is the manner in which such material is available to the art, and when applied may incorporate a series of spaced lines, as at 7, after its installation. On the other hand, it is just as likely that the adhering means 6 of this invention may extend uniform throughout its entire extent after application to the bar means of this invention. In addition, the adhering means of this invention may be applied either to the upper surface 4 of the bar means, as shown, or likewise could be applied also to the bottom surface 5 of the same bar means, so as to provide a double faced adhering means upon the bar means for ready application and gripping of any wiping cloth material that is initially adhered to, and wrapped about, the apparatus in preparation for its usage. The double faced application is preferred.

The form of adhesive used for holding the adhering means 6 onto the bar surfaces is preferably of the type that will be resistant to breakdown when exposed to the various solvents which may be applied to the wiping cloth in preparation for its cleaning function. Such adhesive may be one which is generally identified in the trade as No. 465 adhesive, which may be obtained from 3M Company, Minneapolis, Minn., as aforesaid. It is desirable that the adhering means 6 and 8 be permanently installed onto the bar means of this invention, and be sustained thereat, even after repeated applications of wiping materials thereon, even after a multitude of soakings by any form of solvent, or the like, for prudent and reasonable lengths of time as aforesaid, as used in the trade for this particular cleansing purpose.

Figure 4:
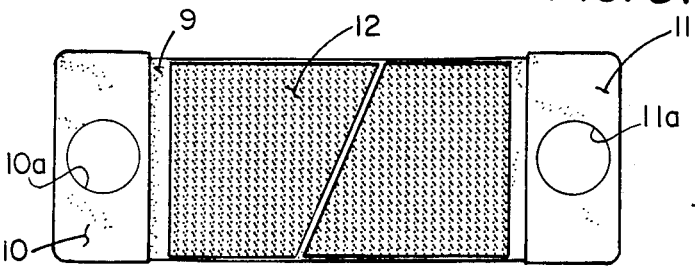
FIG. 4 is a plan view of the modified style of bar means, simply being approximately one-half the size in length of the apparatus as shown in FIG. 2.
Figure 6:
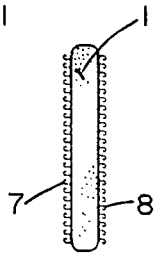
FIG. 6 is an end edge view of the bar means of this invention as shown both in FIGS. 2 and 4.
Figure 5:
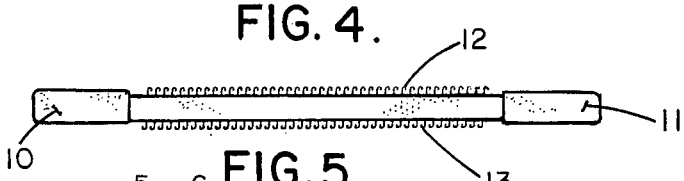
FIG. 5 provides a front edge view of the bar means shown in FIG. 4.

FIGS. 4 and 5 disclose how the subject matter of this invention may be fabricated to various dimensions, and in this particular instance, the bar means 9, having its lateral hand gripping portions 10 and 11 incorporate the adhering means 12 and 13 upon its upper and lower surfaces. Obviously, the cleaning apparatus of this invention may be employed for use upon plates, films, or proofs, of smaller dimensions. In addition, it is to be noted that the portions 10 and 11 have shallow cavities **10*a* and 11*a*** therein, perhaps even on both sides, to facilitate the hold upon the gripper during its application.

Figure 7:
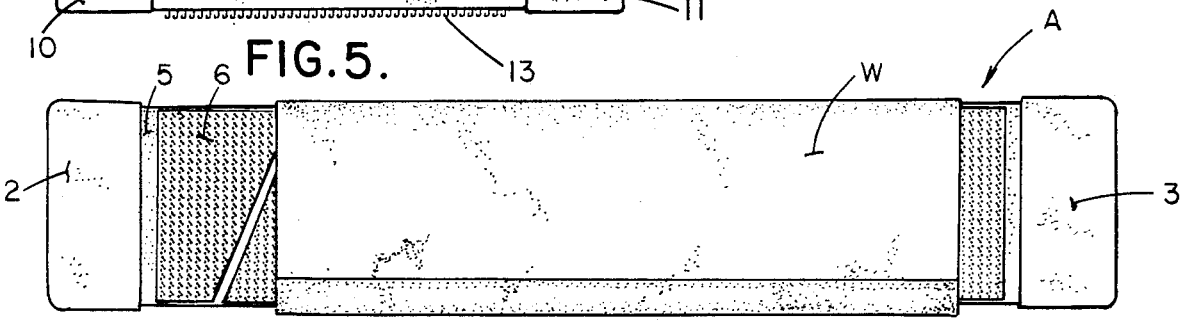
FIG. 7 provides a plan view of the gripper bar means shown in FIG. 2, but in this particular instance, disclosing a wiping cloth, as formed of thin dimensioned foam material, having been wrapped about the bar in preparation for its usage.

FIG. 7 shows the application of a form of wiping cloth W, in this particular instance, comprising the foam type of pad, such as that which may be obtained from Wellhan, of (blank). The foam pad of this type is of relatively thin dimension, being approximately one-eighth to one-fourth inch in thickness, and having the width as shown when applied upon the gripping apparatus A of this invention. As can be seen, the wiping cloth W, which in this particular instance is of that foam texture, extends a substantial length of the bar means 5, being held firmly in place through its multiple wrappings about the "hooked" adhering means 6 and 8 of the invention, as shown.

Figure 8:
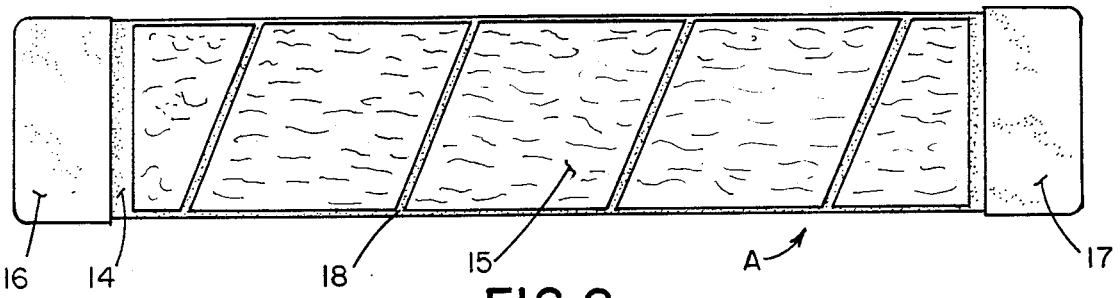
FIG. 8 is a plan view of a related style of gripper bar means as shown in FIG. 2, but in this particular instance, showing the application of the pile form of connector means providing the adhering means to which the wiping pad is initially attached in preparation for its wrapping about the shown bar means.
Figure 9:
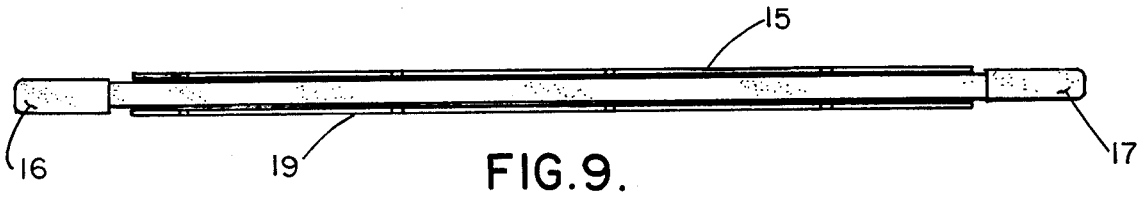
FIG. 9 is a front edge view of the apparatus as seen in FIG. 8.

A further modification to the invention, not so much from the structural standpoint, with respect to the configuration of the bar means 14 itself, but rather, in the makeup of the adhering means 15, is shown in FIGS. 8 and 9. In this particular embodiment, the adhering means herein is formed more of the texture of the "pile" type of connector means, as may be found in the structure of that component used in the Velcro form of connector. While the pile type of adhering means is not as effective as the hooked form, as previously explained, it does at least have sufficient frictional adhesion to the available wiping cloths, whether they be formed of a foam texture, or more preferably of cloth, for initially adhering the same thereto, as the cloth is being wrapped about the apparatus. In this particular embodiment, all other features about the apparatus A are similar in construction to that which has been previously defined, incorporating the hand gripping means 16 and 17, at either end, and which may further be coated, as previously explained, to facilitate their adherence by the hand during application. As can be seen, the adhering means may be segmented, having lines of separation 18 provided intermediate thereof, or it may be a solid covered adhering means, throughout the length of the bar means 14, to the dimensions as shown, and be applied not only upon the upper surface of the bar means, as shown in 15, but likewise be available upon its underside, as at 19, to assure convenient and retained wrapping of the cloth about the apparatus, and to prevent flopping or stubbing of the pad while in use.

Figure 10:
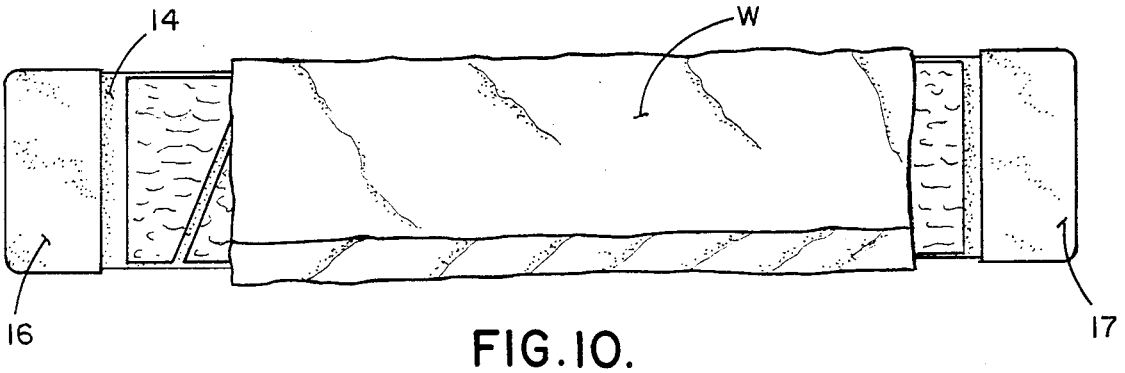

As can be seen in FIG. 10, the cloth textured wiping pad, as at W, is shown wrapped about the bar means 14, of this invention.

Figure 11:
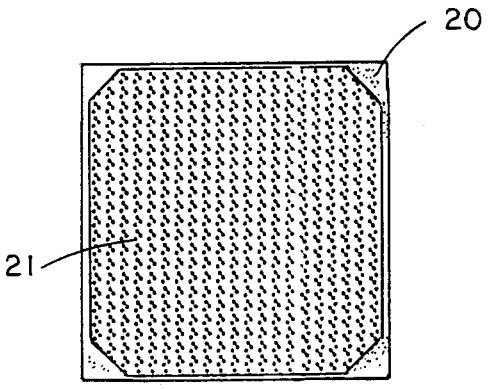
FIG. 11 is a plan view of another style of gripper apparatus of this invention, and in this particular instance, being a hand held size of bar means of this invention.
Figure 12:
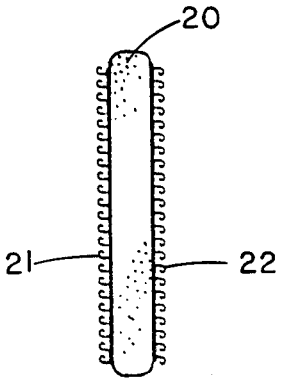
FIG. 12 is an edge view of the gripping apparatus disclosed in FIG. 11, and which edge view could be observed along any of the disposed edges for this form of apparatus of this invention.

FIGS. 11 and 12 show a further modification to the gripping apparatus of this invention. In this particular instance, the bar means 20 may be fabricated to a square configuration, being generally hand size in dimensions, so as to provide a unitary apparatus that can be held by the single hand, and applied for wiping smaller proofs of lesser dimensions. It just may not be necessary that the wiping apparatus be to the full width as shown in FIGS. 2 and 8, for proofs of smaller dimension, but to the contrary, a single hand sized device, as shown in these figures, may prove adequate. Then, each surface of the bar means 20 may include the hook or pile style of adhering means, as shown at 21 and 22, held by the type of adhesive, as previously explained, and which will function most effectively in maintaining the integrity of the gripping apparatus of this invention, even after repeated uses.

It may be stated, although repetitiously, that the types of wiping cloths available in the art are that which are of the cloth texture, such as the Webril pad, available from Graphic Suppliers, Inc. of St. Louis, Mo. In addition, the foam style of pad currently used is generally obtainable from Graphic Colour, Inc. of St. Louis, Mo. Furthermore, the various shapes given to the bar means of this invention, as further summarized, may be of a variety of designs, whether it be a bilateral, trilateral, quadrilateral, or polygonal bar which may provide surfaces against which multiple cleanings of a surface may be performed.

In operation, the pad gripping apparatus of this invention may be employed for typical usage in wiping the unexposed ink or other chemicals from a pre-printing press proof. Obviously, as previously explained, in any such photographic function, the previously exposed photo image remains intact, particularly after toner application, but the unexposed portion requires removal in order to disclose the completed, or semi-completed proof, depending upon the multitude of toner colors that are or may be applied during its preparation. Following this, one of the wiping cloths of this invention may be rested upon the proof surface, or against some other surface, and then the bar means of this invention is placed so that its front edge aligns with the front edge of the intended wiping cloth. The bar is then pressed down so as to allow the "hooks", or the "pile", of the adhering means on the bar to engage the fibers or foam of the pad and thereby stick to the surface of the bar. Then, this leading edge of the pad gripper bar means is pivoted, or turned, onto its backside, until its comes to rest upon the pad, but at this time, upon the back side or lower portion of the now turned bar means. Following this, the bar means is repeatedly turned until all of the wiping pad is wrapped about the apparatus. Then, pressure is applied to the top of the bar means to further engage the adhering means to the pad, so as to assure its retention thereon, and to prevent any flopping or stubbing of it during the apparatus's usage. At this stage, the wiping pad is now attached firmly to the bar means, securely enough for use for wiping/cleaning of the plate, film, or the like. Then, the wiping pad may be used in the dry stage, to wipe the film clean, at those locations where unexposed ink needs to be removed, or a cleaning solution of the type normally used in the trade may be applied to the pad, preferably upon both surfaces. The bar is then placed to the backside or upper edge of the item to be cleaned, with the cleaning or saturated side facing downwardly, contiguously against that surface to be cleaned. In addition, the rounded edge of the pad will be pointing in a direction towards its operator. The bar is then pulled with a consistent pressure towards the operator, and the wiping process is repeated, either in a reciprocal manner towards and away from the operator, or repeatedly in one direction, as explained, until the image is completely exposed, and all residue material, ink, or other chemicals are removed, and wiped clean. Both sides of the pad may be used in this manner, for completing a cleaning function. Once that is effected, the pad may be simply unwound from the gripping apparatus, and disposed of. The cleaning function has now been completed, the wiping pad required a minimum of effort to achieve its setup, application, and even disposal, after performance of a cleaning operation.

Variations or modifications to the subject matter of this invention may occur to those skilled in the art upon reviewing the description provided herein. Such variations, if within the spirit of this invention, are intended to be encompassed within the scope of any claims to patent protection issuing upon this development. The description of the preferred embodiment set forth herein is done so for illustrative purposes only.

Having thus described the invention what is claimed and desired to be secured by Letters Patent is:

1. A wiping and cleaning pad adhering apparatus for use in holding a pad of material for application in cleaning the surface of a printing plate, proof, film, or the like, the apparatus including a length of bar means having sufficient width to facilitate its grasping by the user, said bar means having at least a pair of surfaces, a hook connecting means permanently applied substantially to at least one of the said surfaces and disposed for gripping onto the pad of material and retaining the same as it is rolled onto the bar means in preparation for usage and application for a cleaning function, said hook connecting means being applied substantially over the length of said bar means, adhesive means securing said hook connecting means to said bar means, said bar means having portions extending laterally to either side of the said applied hook connecting means, said extending portions designed for functioning as hand gripping means for facilitating the operator's holding of the apparatus during usage.

2. The invention of claim 1 and wherein said bar means having four sides, and said hook connecting means being applied substantially over the length of one of said bar side means.

3. The invention of claim 1 and including a coating applied substantially to the said laterally extending portions of the bar means, said coating useful for enhancing the grip of the user of said apparatus.

4. The invention of claim 8 and wherein said coating comprising a polymer.

5. The invention of claim 8 and wherein said coating being a rubber composition.

6. The invention of claim 1, and wherein said extending portions being shaped to facilitate the user's grip during application of the apparatus.

7. The invention of claim 11 and wherein said shaped portion, formed as a shallow cavity.

8. The invention of claim 12 and wherein said shallow cavity being annular.

9. The invention of claim 11 and wherein said shaped portion including at least one aperture.

10. The invention of claim 1 and wherein said hook connecting means being segmented over the length of said bar means and incorporating spaced lines of separation between adjacent segments.

* * * * *

UNITED STATES PATENT AND TRADEMARK OFFICE

CERTIFICATE OF CORRECTION

PATENT NO. : 4,720,888

DATED : January 26, 1988

INVENTOR(S) : John A. Menz

It is certified that error appears in the above-identified patent and that said Letters Patent are hereby corrected as shown below:

Column 8, line 43, change "8" to ---3---.

Column 8, line 45, change "8" to ---3---.

Column 8, line 50, change "11" to ---6---.

Column 8, line 52, change "12" to ---7---.

Column 8, line 54, change "11" to ---6---.

Signed and Sealed this

Nineteenth Day of July, 1988

*Attest:*

DONALD J. QUIGG

*Attesting Officer*

*Commissioner of Patents and Trademarks*